US010053192B2

(12) United States Patent
Russikoff

(10) Patent No.: US 10,053,192 B2
(45) **Date of Patent: *Aug. 21, 2018**

(54) MEANS FOR DEPLOYING PULLOUT SHADE SYSTEM ONBOARD BOAT

(71) Applicant: Ronald K. Russikoff, Philadelphia, PA (US)

(72) Inventor: Ronald K. Russikoff, Philadelphia, PA (US)

(73) Assignee: RODAN ENTERPRISES, LLC, Philadelphia, PA (US)

( * ) Notice: Subject to any disclaimer, the term of this patent is extended or adjusted under 35 U.S.C. 154(b) by 311 days.

This patent is subject to a terminal disclaimer.

(21) Appl. No.: 14/121,925

(22) Filed: Nov. 4, 2014

(65) Prior Publication Data

US 2015/0122169 A1 May 7, 2015

Related U.S. Application Data

(60) Provisional application No. 61/962,397, filed on Nov. 6, 2013.

(51) Int. Cl.
*B63B 17/02* (2006.01)
*E04H 15/46* (2006.01)

(52) U.S. Cl.
CPC ..... *B63B 17/02* (2013.01); *E04H 15/46* (2013.01)

(58) Field of Classification Search
CPC . B63B 17/02; B63B 17/023; B63B 2017/026; E04H 15/46
See application file for complete search history.

(56) References Cited

U.S. PATENT DOCUMENTS 7,093,558 B1 * 8/2006 Mandanici ..... B63B 17/02 114/361
9,139,258 B2 * 9/2015 Russikoff ..... B63B 17/02

* cited by examiner

*Primary Examiner* — Andrew Polay
(74) *Attorney, Agent, or Firm* — Armand M. Vozzo, Jr.

(57) ABSTRACT

An improved mounting device and assembled configuration for deploying a manually operated pullout shade system of the type having a tensioned roller member carrying a flexible canvas sheet and parallel tubular actuators therefor. In one embodiment of the present invention, a mounting device is disclosed for securing the manual pullout shade system onto an arching tubular overhead structure onboard a boat so that the pullout shade may be adjusted in its working attitude and maintained in proper position for deployment. The mounting device includes a set of clamp members each constructed in the form of a figure "8" with associated circular sections on each clamp member being rotatably coupled together. The circular sections of the clamp members are further adapted to engage about sections of the tubular actuators and nearby portions of the overhead structure thereby providing an adjustable joint coupling between them that allows the pullout shade and its tubular actuators to be placed in various positions for deployment. In a second embodiment, the tensioned roller member of the pullout shade system is attached along the front of rooftop structure on the boat and the tubular actuators are separated therefrom and set apart vertically within the gunnel of the boat on opposite sides near the bow. In this assembled configuration, the canvas sheet may be drawn forward from the rooftop structure on the tensioned roller member and the tubular actuator pulled into extended upright positions to connect with the canvas sheet and support the extended forward deployment of the shade system.

1 Claim, 8 Drawing Sheets

MEANS FOR DEPLOYING PULLOUT SHADE SYSTEM ONBOARD BOAT

CROSS-REFERENCE TO RELATED APPLICATION

This application is a continuation-in-part of provisional patent application Ser. No. 61/962,397 filed Nov. 6, 2013 for Means for Deploying Pullout Shade System Onboard Boat.

BACKGROUND OF THE INVENTION

The present invention relates to retractable shade systems for boats and their associated deployment, and more particularly to improved structural means for deploying a manually operated shade system onboard a boat where shade cover may not otherwise be provided.

In recreational boating, the so-called "bimini top" is a convertible cover erected upon the deck of the boat and made to be deployed at an elevation comfortably above the heads of the passengers. Drawing its name from the Bimini islands in the Bahamas where it was first employed by boaters to provide desired shade from the strong rays of the tropical sun, the standard type of bimini top and those convertible boat covers of the same nature generally comprise a flexible canvas material secured to a foldable support frame that is erected across the deck and pivotally attached thereto. These standard types of foldable bimini tops can be raised when needed or lowered into a substantially flat position upon the deck when not in use or when an overhead obstruction may otherwise require its lowering. While deployment of these folding type bimini tops was often done manually, some were designed to be automated in their operation, the latter requiring electrical power, such as those described in U.S. Pat. No. 6,209,477 to Briedenweg and U.S. Pat. No. 6,983,716 to Ankney et al. Regardless of their specific foldable structure or method of operational deployment, the installation and utilization of bimini tops have became increasingly important for the protection of passengers and crew on board boats against excessive sun exposure and the known risks of skin cancer caused thereby.

While providing effective sunshade protection, the assembled structure of these folding bimini top arrangements, typically including a plurality of poles or bow-like members pivotally mounted across the boat deck, would often obstruct a person on board from reaching out over the side of the boat when fishing, docking or mooring the boat and further present an obstacle in boarding and loading equipment onto the deck. To overcome these obstacles and still provide effective sunshade protection, retractable canopy systems were devised and developed as retrofits for recreational boats capable of operative attachment to existing overhead structure on the boat without causing obstructions upon the deck. As retrofits, such retractable canopy systems were designed to mount onto existing rooftop members set over the deck of a boat or upon other elevated structures, such as radar arches or towers. These prior art retrofit canopy systems include those designed to be manually operated, such as those described in U.S. Pat. No. 4,951,594 to Feikama and U.S. Pat. No. 6,439,150 to Murphy et al., and those designed to be automated in their operation, such as those described in U.S. Pat. Nos. 7,571,691, 7,895,964 and 7,950,342 to Ronald K. Russikoff. These latter automated systems have featured a telescopic framework or so-called "teleframe" design that mounts directly to a rooftop or other overhead structure on the boat without need for side-supporting poles thereby easing the handling of dock lines and boarding of the boat and providing clear unobstructed views while on board.

While these prior art canopy systems have been generally satisfactory in their intended manual or automated deployment upon boats, some drawbacks have arisen in their implementation and usage. The powered automated systems, for example, while providing relatively quick and easy deployment in a self-supporting framework, are rather burdensome in the weight of their assembled components and further involve a significant amount of retrofit labor in the mounting and routed connections that these automated systems generally require. As a result, these powered automated systems have tended to be installed and implemented on larger and more luxurious vessels where the cost of installation and implementation have a lesser impact upon the boat owners. Manual boat shade systems, on the other hand, are generally lighter in weight and more simple in their retrofit attachments, but have been somewhat limited in their operational deployment upon certain smaller, relatively lightweight recreational boats that have limited overhead surface areas, such as T-top center console fishing boats, bow rider boats, and wake board boats. These smaller recreational boats require a more compact and lightweight retractable canopy system that will better accommodate their limited overhead surface areas and better fit with their existing structure. Such an improved retractable system was devised and recently published in U.S. Patent Publication No. 2013-0206050-A1 for a Pullout Shade System for Boats that is self-supporting in its structure and "teleframe" in its characteristic design but completely manual in its operation and able to be safely secured and deployed on a wide variety of smaller recreational boats. Still, however, this self-supporting and completely manual pullout shade system did not adapt well to mounting upon the arching tubular overhead structure typically found on many smaller recreational boats and used to secure radar and other boat equipment for operations. A need therefore exists for an improved means for mounting this self-supporting teleframe system on arching tubular overhead structures of the boat. Furthermore, there is an associated need to provide improved means for extending deployment of such a pullout shade system forwardly from rooftop structures along the front portion or bow of the boat where extended shade coverage has been limited and difficult to effect.

SUMMARY OF THE INVENTION

Accordingly, it is a general purpose and object of the present invention to provide improved means for deploying a manually operated retractable shade system on a boat to increase the comfort and protection of those onboard.

A more particular object of the present invention is to provide an improved means for extending shade coverage onboard a boat from overhead structures that have heretofore presented problems in supporting retractable shade systems.

Another object of the present invention is to provide an improved means for mounting a self-supporting manually operated retractable boat shade system having a telescopic framework so that the shade may be deployed effectively from arching tubular overhead structure typically found on smaller boats.

Still another object of the present invention is to provide an improved means for deploying a self-supporting pullout shade system from rooftop structure on a boat forwardly along the front portion or bow of the boat where extended shade coverage has been limited and difficult to effect.

A further object of the present invention is to provide an improved manually operated boat shade system that extends to the bow of the boat and is safe and reliable to use whether the boat is resting in calm water or moving about on high seas.

A still further object of the present invention is to provide an improved means for extending deployment of a manually operated boat shade system that is relatively inexpensive to manufacture, assemble and install in a working unit affordable to a substantial number of boat owners.

Briefly, these and other objects are accomplished by an improved mounting device and novel assembled configuration for deploying a manually operated pullout shade system of the type having a tensioned roller member carrying a flexible canvas sheet and parallel tubular actuators therefor. In one embodiment of the present invention, a mounting device is disclosed for securing the manual pullout shade system onto an arching tubular overhead structure onboard a boat so that the pullout shade may be adjusted in its working attitude and maintained in proper position for depyment. The mounting device includes a set of clamp members each constructed in the form of a figure "8" with associated circular sections on each clamp member being rotatably coupled together. The circular sections of the clamp members are further adapted to engage about sections of the tubular actuators and nearby portions of the overhead structure thereby providing an adjustable joint coupling between them that allows the pullout shade and its tubular actuators to be placed in various positions for deployment. In a second embodiment, the tensioned roller member of the pullout shade system is attached along the front of rooftop structure on the boat and the tubular actuators are separated therefrom and set apart vertically in the gunnel or narrow ledge extending along both sides of the boat to the bow. In this assembled configuration, the canvas sheet may be drawn forward from the rooftop structure on the tensioned roller member and the tubular actuator pulled into extended upright positions to connect with the canvas sheet and support the extended forward deployment of the shade system.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DETAILED DESCRIPTION OF THE INVENTION

Figure 1:
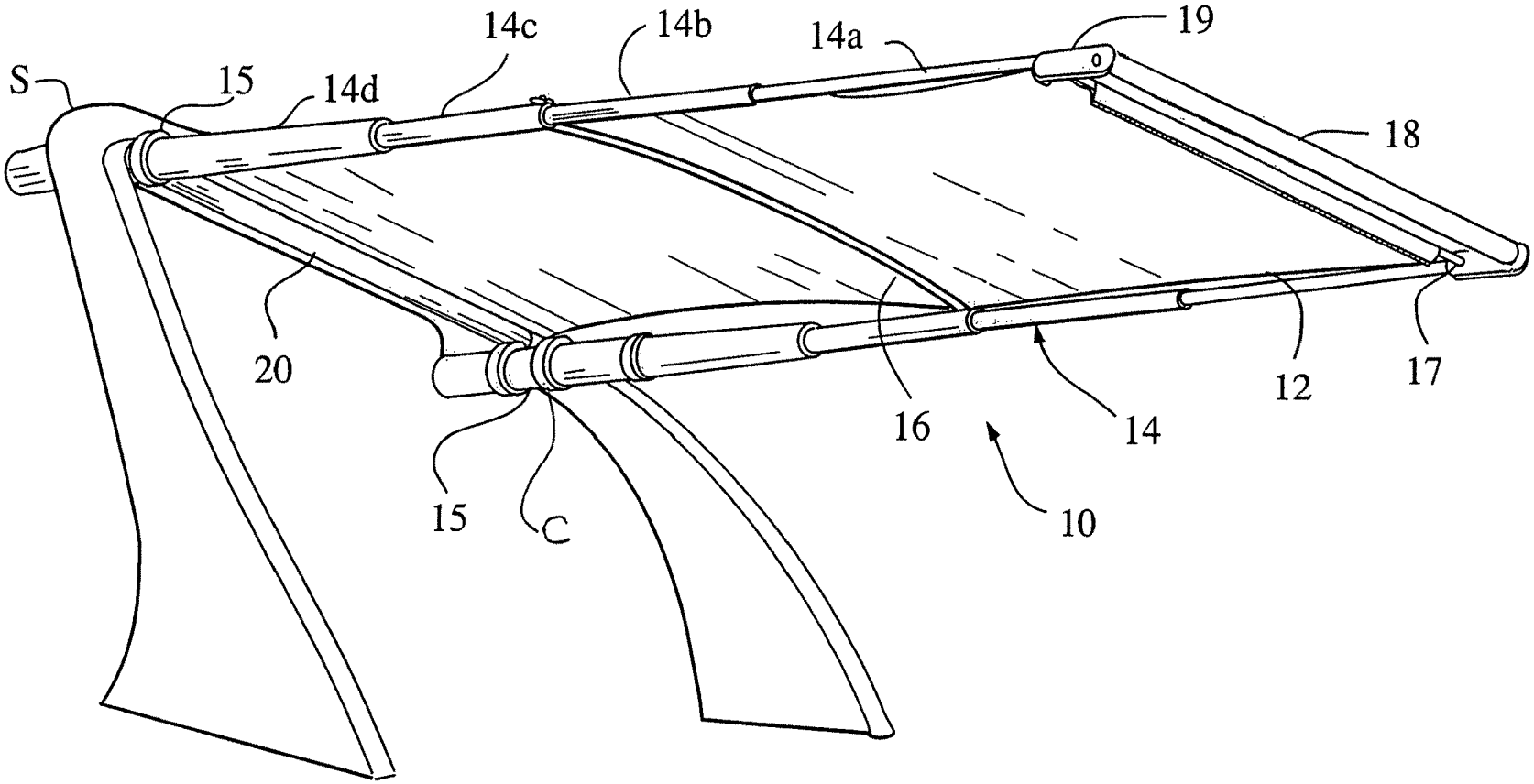
FIG. 1 is a perspective view of a pullout shade system for boats having a pair of parallel telescopic actuator tube assemblies shown in extended deployment mounted to a standard radar arch.
Figure 2:
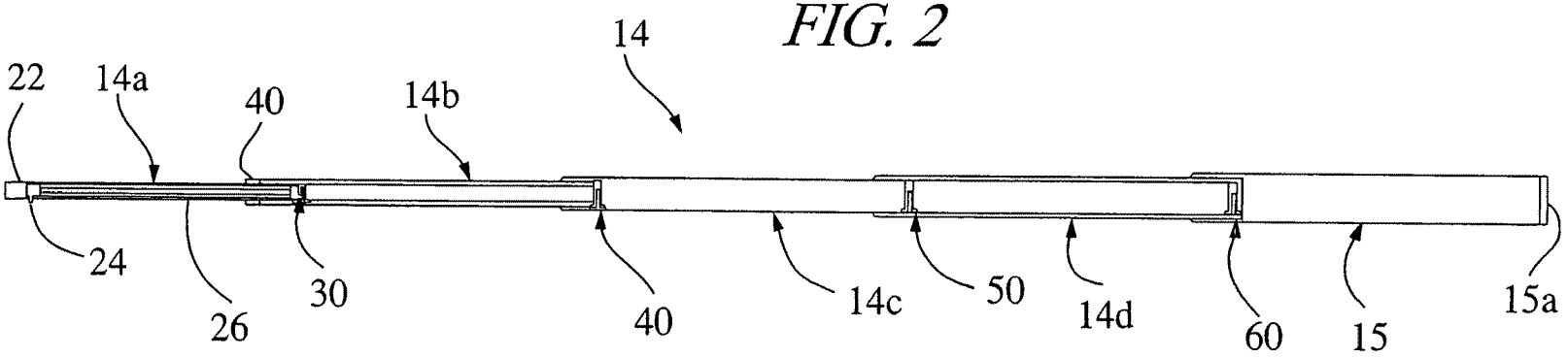
FIG. 2 is a longitudinal plan view of one of the pair of tubular actuator assemblies used in the pullout shade system of FIG. 1 and shown in its fully extended state with portions cut away along the length.
Figure 2A:
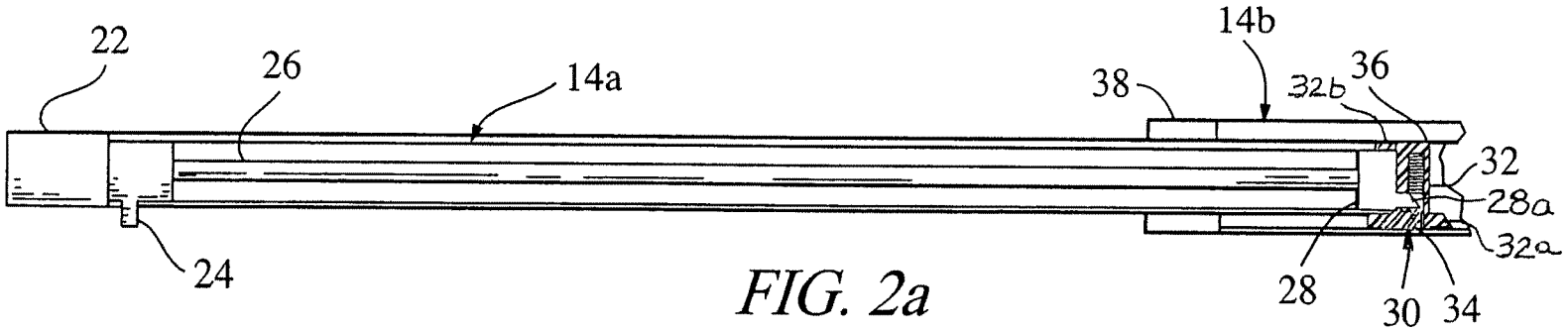
FIG. 2*a* is an enlarged longitudinal view of the front portion of the extended tubular actuator assembly of FIG. 2 showing internal engagement of successive tubular members during retraction of the shade system.
Figure 3:
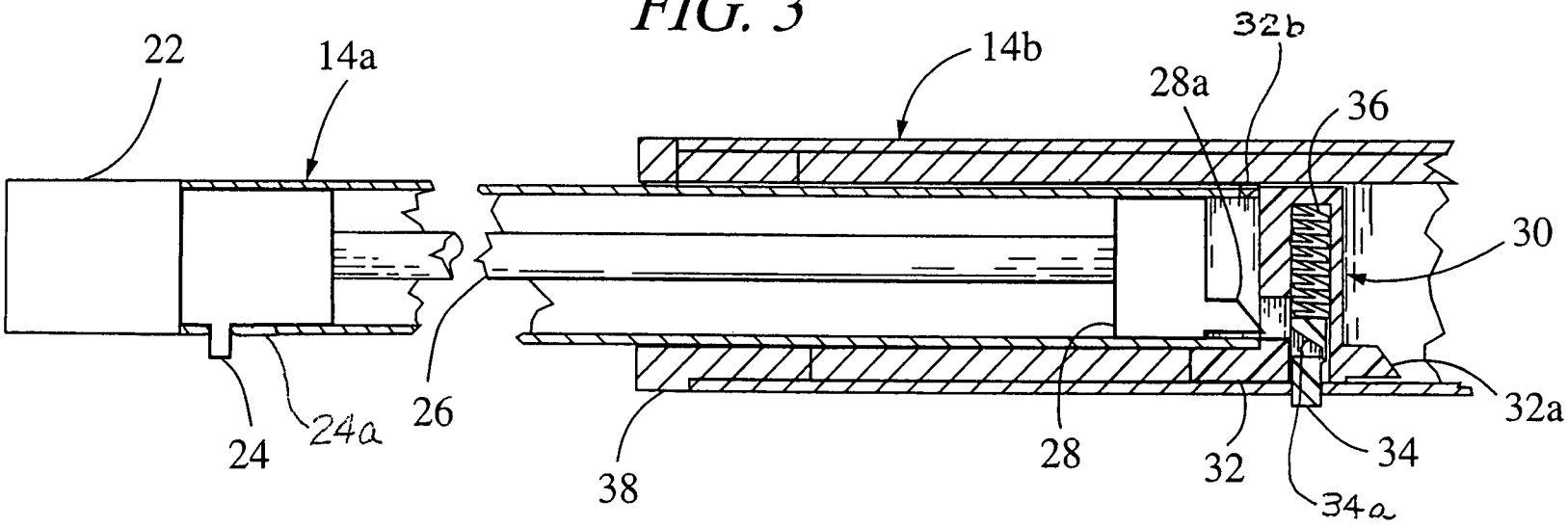
FIG. 3 is an enlarged longitudinal view partially sectioned and cut away of the front end portion of the extended tubular actuator assembly shown in FIG. 2.
Figure 4:
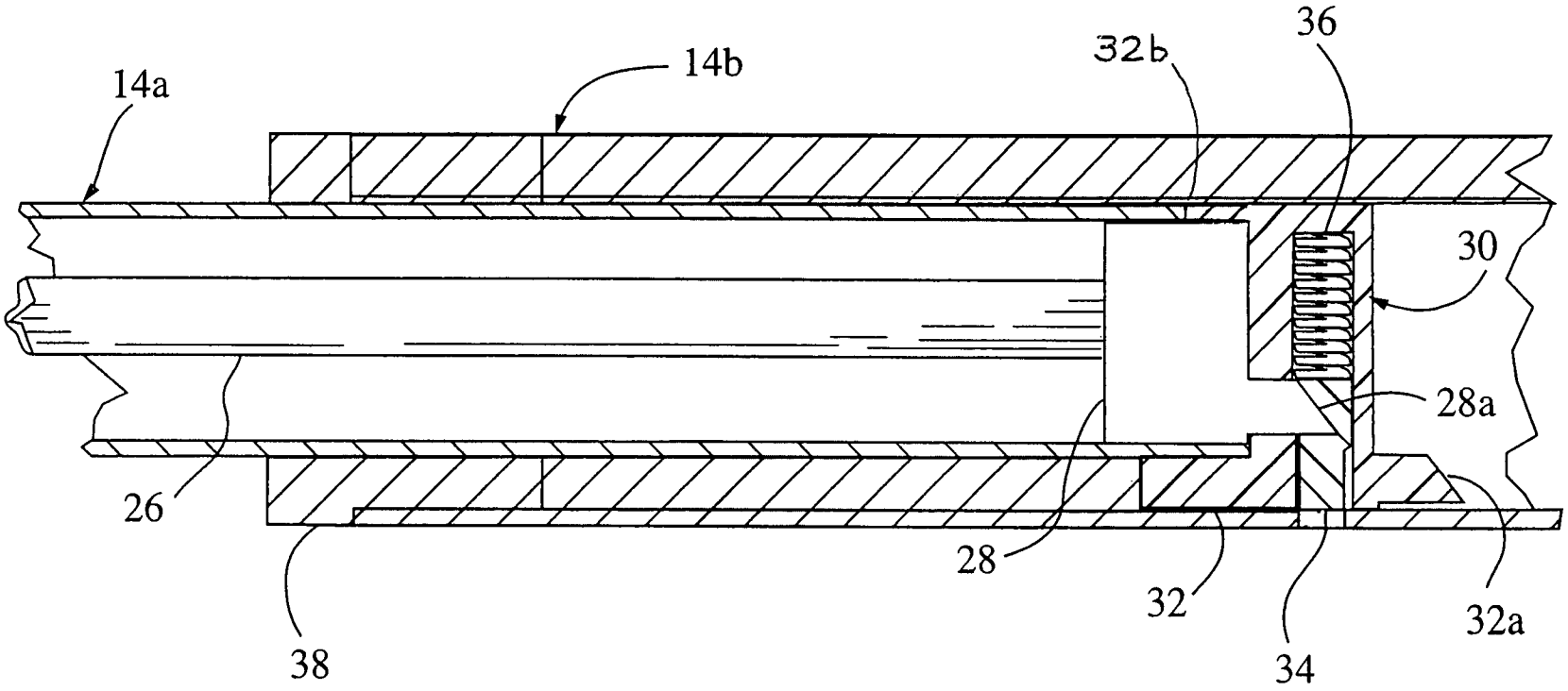
FIG. 4 is a longitudinal view partially sectioned and cut away of the internal engagement of the first and second stages of the tubular actuator assembly during manual retraction of the pullout shade system.
Figure 5:
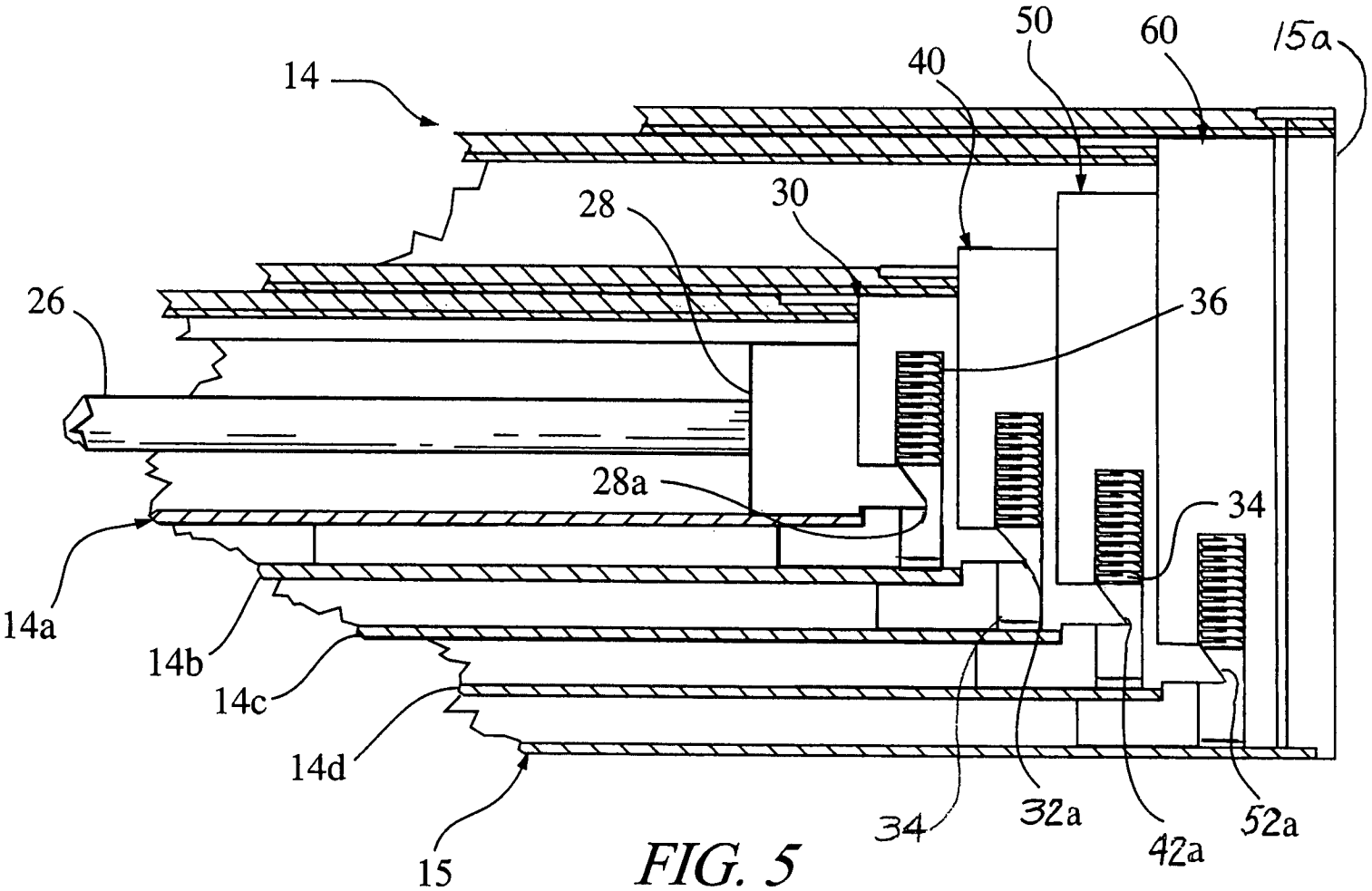
FIG. 5 is an enlarged longitudinal view partially sectioned and cut away showing the back end of the tubular actuator assembly when fully retracted.

The following is a detailed description of preferred embodiments of the present invention and the best presently contemplated mode of their production and practice. This description is further made for the purpose of illustrating the general principles of the invention but should not be taken in a limiting sense, the scope of the invention being best determined by reference to the appended claims.

Referring to the drawings, the following is a list of structural elements associated with the present invention and its corresponding embodiments. Since the described embodiments of the present invention are directly associated with aspects of the structure and operational deployment of a "Pullout Shade System for Boats" heretofore described by the Applicant with its teachings found in the Specification of U.S. Patent Publication No. 2013-0206050-A1, that published Specification is herein incorporated by reference. Together with the manual pullout shade system generally designated 10, the associated elements employed in connection with the present invention are as follows:

12 canvas sheet material;
14 tubular actuator assembly;
14*a* first stage tubular member;
14*b* second stage tubular member;
14*c* third stage tubular member;
14*d* fourth stage tubular member;
15 stationary rearward tubular member;
15*a* end cap;

16 intermediate crossbar;
17 forward crossbar;
18 handle bar;
19 extension plate;
20 tensioned roller member;
22 front cap;
24 actuator lever member;
24*a* actuator slot;
26 actuator shaft;
28 unlocking lever member;
28*a* angled post;
30 first end cap assembly;
32 end cap member;
32*a* end cap post;
32*b* end cap guide;
32*c* end cap chamber;
34 locking pin;
34*a* angled slot;
36 compression spring;
38 forward bearing sleeve;
40 second end cap assembly;
40*a* second end cap post;
50 third end cap assembly;
50*a* third end cap post;
60 fourth end cap assembly;
60*a* fourth end cap post;
70 mounting clamp device;
72 clamp members;
74*a/b* circular clamp sections;
75 arching tubular overhead structure;
B recreational boat;
R rooftop structure of boat; and
G gunnel of boat.

Figure 6:
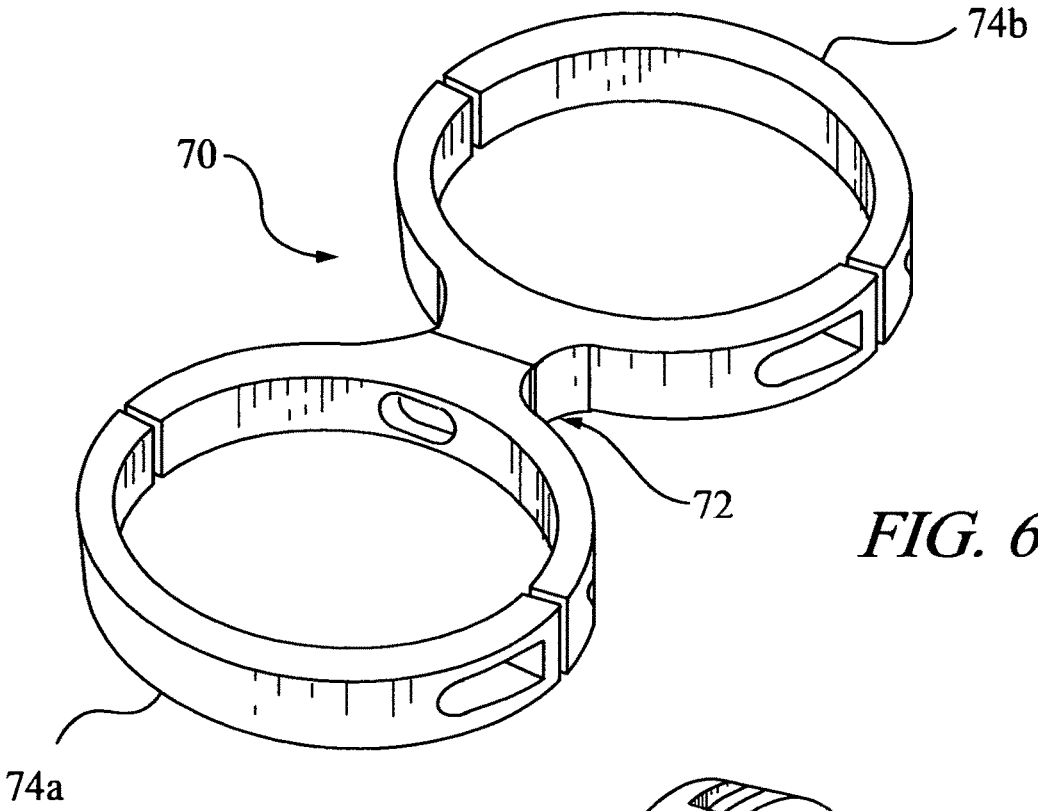
FIG. 6 is a perspective view of a clamp member made in a figure-8 form according to the present invention with its rotatable circular sections here shown lying in the same plane.
Figure 7:
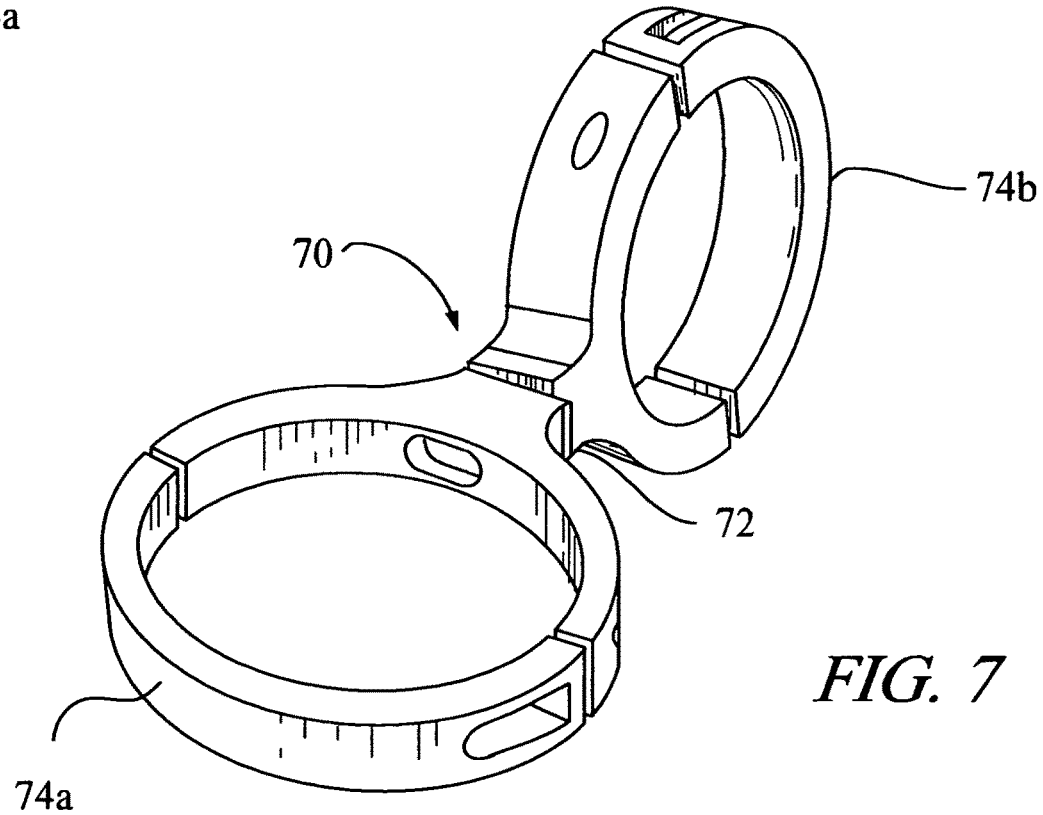
FIG. 7 is a further perspective view of the present clamp member here shown with the rotatable circular sections turned at a 90° angle relative to each other.
Figure 8:
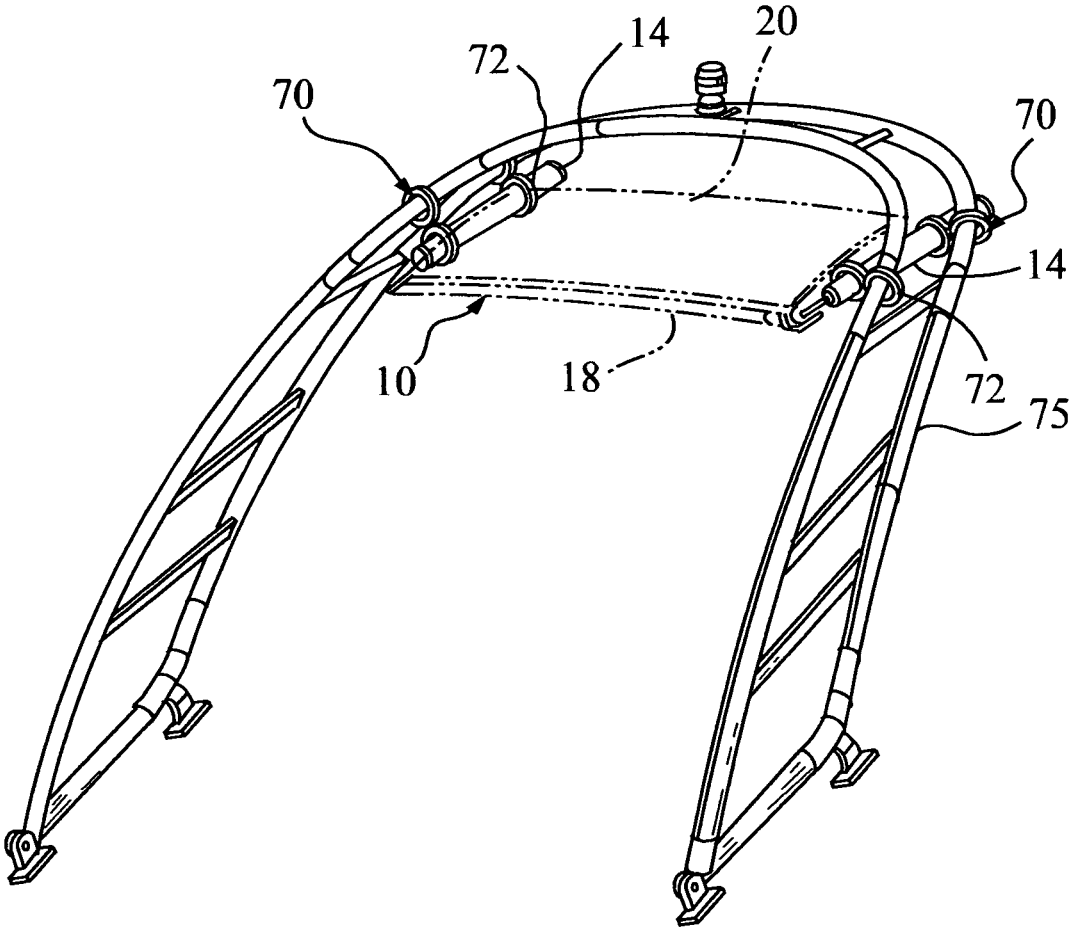
FIG. 8 is a front perspective view of an arching tubular overhead structure of the type erected on a recreational boat, here shown with a pullout shade system mounted thereon using a plurality of the clamp members of FIGS. 6 and 7.

Referring now to FIGS. 6, 7 and 8 in conjunction with FIGS. 1-5, a mounting clamp device 70 is devised for providing a flexible but secure mount of the pullout shade system 10 and its parallel pair of tubular actuator assemblies 14 onto tubular overhead structure 75 in multiple ways. The mounting clamp device 70 comprises one or more clamp members 72 each constructed in the form of a figure "8" with associated circular sections 74*a*, 74*b* that are set together along the common line of their diameters and rotatably connected so that each circular section may be turned 360° about the common diameter line. Each of the circular sections 74*a*, 74*b* of the clamp members 72 are adapted to fit upon and engage about cylindrical sections of the respective tubular actuator assemblies 14 holding them in turn together with proximal portions of the overhead tubular structure, as shown in FIG. 8. The clamp members 72 through its rotatable circular section 74*a*, 74*b* can rotate on the respective tubular diameters that each engage as well as rotate at the center interface providing a variety of placement configurations for deployment. This rotating engagement feature of the specially configured clamp members 72 thus provides an adjustable joint coupling between the tubular actuators 14 and the tubular overhead structure 75 so that the pullout shade system 10 and its canvas sheet material 12 may set in a desired plane and manually deployed by pulling upon the handle bar 18 and drawing the canvas from the tensioned roller member 20.

Figure 9:
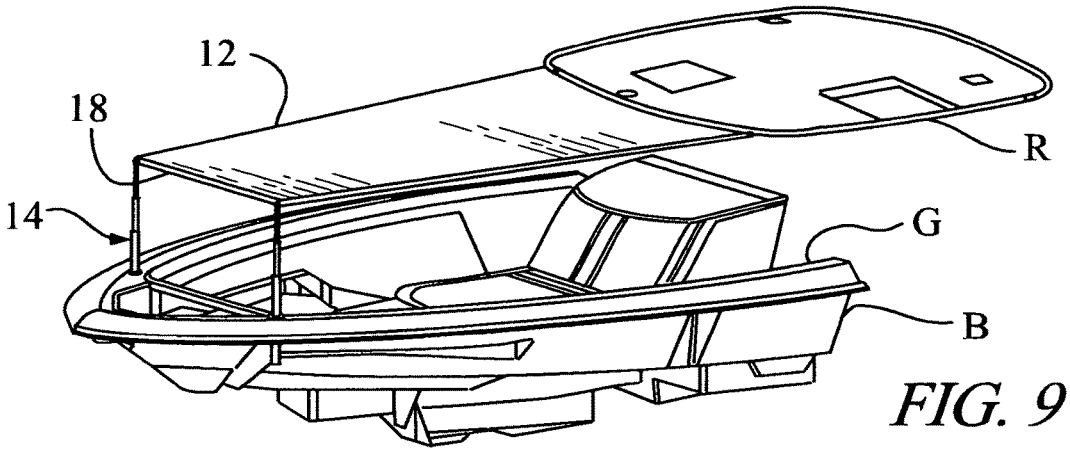
FIG. 9 is a side perspective view of the front portion of a recreational boat having a rooftop structure and a pullout shade deployed forwardly therefrom using an assembled configuration of vertically oriented tubular actuator assemblies to support the deployment in accordance with the present invention.
Figure 10:
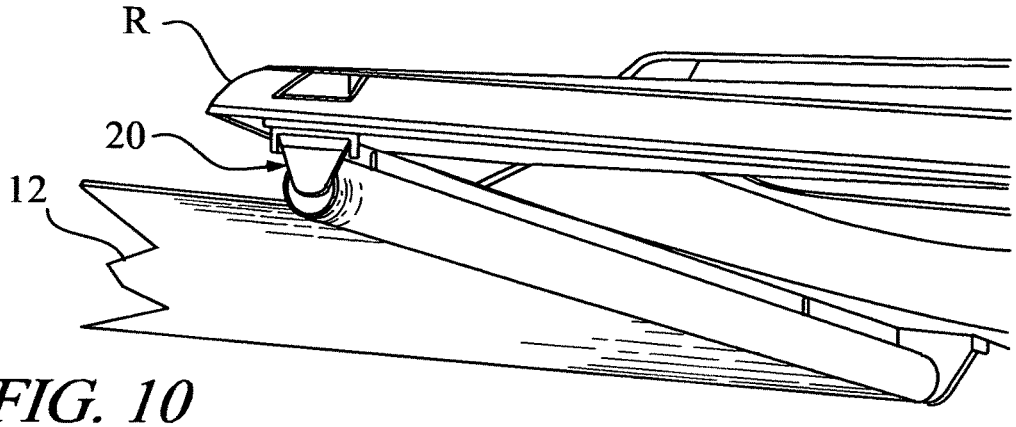
FIG. 10 is a side perspective view from just beneath the rooftop structure seen in FIG. 9, here showing the tensioned roller operatively connected to the front of the rooftop structure for deploying the pullout shade system.
Figure 11:
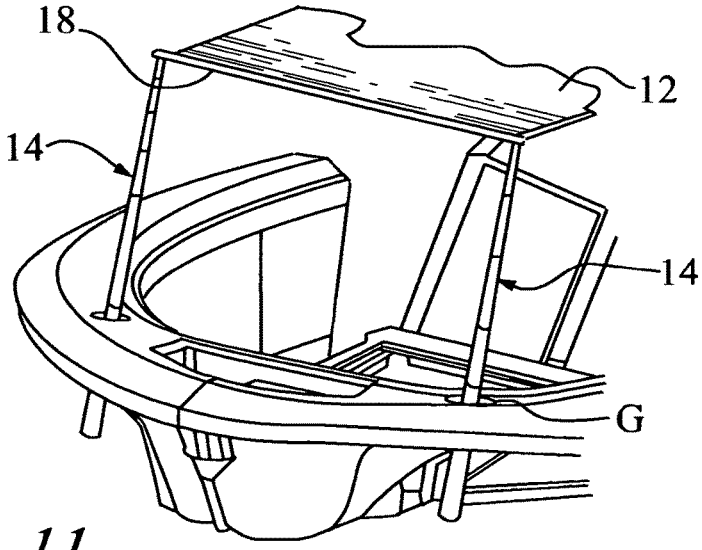
FIG. 11 is a front perspective view of the bow of the recreational boat seen in FIG. 9, here showing the tubular actuator assemblies vertically disposed and extended from the gunnel or upper ledge of the boat along both sides of the bow to support the deployed pullout shade.

Referring now to FIGS. 9, 10 and 11 in conjunction with FIGS. 1-5, an alternate configuration of the standard planar teleframe form of the pullout shade system 10 is assembled and implemented on a recreational boat B for improved manual deployment of the pullout shade system over forward portions of the boat. While in some cases, the self-supported teleframe shade systems have been used in forward-facing application, there are limits to the amount of shade coverage these systems can provide, and due to the layout of many of the recreational boats where the forward shade is desired, forward deployment of the standard self-supported teleframe shades has been problematic and difficult to effect.

In the present assembled configuration, the tubular actuator assemblies 14 are separated from the tensioned roller member 20 of the standard pullout shade system and set apart in substantially vertical attitudes within openings formed through the gunnel G or upper ledge of the boat B along both sides near the bow. The tensioned roller member 20 with handle bar 18 attached to the canvas sheet 12 across the front of the roller member is mounted and secured along the front of rooftop structure R on the boat B. In this assembled configuration and from a fully retracted shade position, the respective tubular actuators 14 are pulled into fully extended upright positions and locked therein by internal spring loaded pins. Then using the handle bar 18, the canvas sheet 12 is pulled forward and across the deck from the rooftop structure R, drawn upon the tensioned roller member 20 in a taut state to the fully extended tubular actuators 14. The extended canvas sheet 12 is then connected across the tops of the fully extended tubular actuators 14 via the handle bar 18 and the tubular actuators serve to provide upright support that maintains the extended forward deployment of the shade system. A retraction of the shade system provided by this assembled configuration proceeds in reverse, beginning with a release of the handle bar 18 and the canvas sheet from the fully extended tubular actuators 14 and a return of the canvas sheet onto the tensioned roller member 20. The tubular actuator 14 may then be retracted into an area beneath the gunnel G where stored when not in use.

This novel assembly and configuration serves many benefits. For example, it provides minimal framework, ease of operation and stowage when shade is not in use. It also provides substantial shade coverage for locations where other shade solutions are not suitable, and provides the ability to shape the canvas to fit application areas. For instance, the roller member can be wider than the pull bar creating a triangle shape to match the shape of the bow of the boat and cover the seating area as shown in FIG. 9. This assembled configuration is especially beneficial while at anchor or at a dock, providing comfortable entertaining areas as well as ease of boarding and panoramic viewing with the minimal framework it requires.

Therefore, it is apparent that the described invention provides an improved means for deploying a manually operated retractable shade system on a boat to increase the comfort and protection of those onboard. The present invention, in both of its embodiments, provide improved structural means for extending shade coverage onboard a boat from overhead structures that have heretofore been problematic. In the embodiment of the mounting device, the present invention provides an improvement for mounting a self-supporting manually operated retractable boat shade system having a telescopic framework so that the shade may be deployed effectively from arching tubular overhead structure typically found on smaller boats. In the mounting configuration embodiment, the present invention provides an improvement for deploying a self-supporting pullout shade system from rooftop structure on a boat forwardly along its front portion or bow where extended shade coverage has been limited and difficult to effect. This mounting configuration provides an improved manually operated boat shade system that extends to the bow of the boat and is stable in its support and reliable to use whether the boat is resting in calm water or moving about on high seas.

Obviously, other embodiments and modifications of the present invention will readily come to those of ordinary skill in the art having the benefit of the teachings presented in the foregoing description and drawings. For example, the described tubular actuator assemblies 14 extended in their substantially vertical attitudes from mounted positions on the gunnel G may be utilized as well to support a separate type of canvas sheet material, not associated with or extended from a tensioned roller, as a deployed shade cover for the front of a boat that would be further secured and supported in connection with a rooftop or other overhead structure on the boat. Otherwise, alternate embodiments of size and shape, as well as substitution of known materials or those materials which may be developed at a future time to perform the same function as the present described embodiments are therefore considered to be part of the present invention. Accordingly, it is understood that this invention is not limited to the particular embodiment described, but rather is intended to cover modifications within the spirit and scope of the present invention as expressed in the appended claims.

What is claimed is:

1. A system for deploying a manually operated pullout shade onboard a boat having an existing rooftop structure at an elevated level on the boat and a gunnel extending along both sides of the boat to the bow, comprising:

a roller member carrying thereon a sheet of a canvas material under tension, said roller member being rotatably mounted to a forward edge of the rooftop structure;

a pair of tubular assemblies each comprising a series of tubular members fitted together and assembled for telescopic movement between a fully retracted and a fully extended position, said pair of tubular assemblies being spaced apart and mounted to the gunnel of the boat near the bow in substantially vertical attitudes so that the tubular members are substantially upright and raised to the elevated level of the rooftop structure in the fully extended position;

a bar member attached to the canvas sheet across the front of said roller member to draw the canvas sheet forward from the rooftop structure and further adapted to engage the uppermost tubular members to deploy the canvas sheet across the front of the boat supported upon the fully extended upright tubular members; and self-engaging locking means operatively connected and fitted within each of said tubular assemblies for staging the telescopic movement of the respective tubular members stages between the fully extended and fully retracted positions, wherein said self-engaging locking means comprises a first lever member releasably engaged within each of said tubular member and adapted to move rearward within the chamber; a shaft operatively connected at one end thereof to said first lever member and adapted to extend rearward through each tubular member; a second lever member attached to the opposite and of the shaft and formed having an extended post with an angled, wedge-like surface projecting rearward therefrom; and end cap means secured at the rearward end of each tubular member and adapted to engage the extended post of said second lever members for releasing the telescopic movement of each of said tubular members as the extended post is engaged.

* * * * *